United States Patent [19]

Christensen

[11] 4,132,589

[45] Jan. 2, 1979

[54] DELIGNIFICATION AND BLEACHING OF CELLULOSE PULP

[76] Inventor: Per K. Christensen, Henrik Angells gt. 31, 7000 Trondheim, Norway

[21] Appl. No.: 568,055

[22] Filed: Apr. 14, 1975

[30] Foreign Application Priority Data

Apr. 17, 1974 [NO] Norway ..... 741375

[51] Int. Cl.[2] ..... D21C 9/10

[52] U.S. Cl. ..... 162/65; 8/111; 162/90

[58] Field of Search ..... 162/65, 90; 8/111

[56] References Cited

U.S. PATENT DOCUMENTS

| | | | |
|---|---|---|---|
| 321,452 | 7/1885 | Pond | 162/65 X |
| 415,608 | 11/1889 | Brin | 162/65 X |
| 3,843,473 | 10/1974 | Samuelson et al. | 162/65 X |

FOREIGN PATENT DOCUMENTS

| | | | |
|---|---|---|---|
| 2100703 | 7/1971 | Fed. Rep. of Germany | 162/65 |

*Primary Examiner*—Arthur L. Corbin

*Attorney, Agent, or Firm*—Haseltine, Lake, & Waters

[57] ABSTRACT

Cellulose pulp is mixed with a base consisting of magnesium oxide, magnesium hydroxide or magnesium peroxide, and treated with oxygen gas at an elevated pressure, at a temperature in the range of 90°–160° C, preferably 120°–140° C for 0.5–6 hours in the absence of alkali metal hydroxide.

3 Claims, No Drawings

DELIGNIFICATION AND BLEACHING OF CELLULOSE PULP

The present invention refers to the reduction of the lignin content and bleaching of semi-chemical or chemical cellulose pulp by means of oxygen gas in the presence of magnesium hydroxide and in the absence of alkali metal hydroxide.

It is previously known to remove lignin from cellulose pulp by means of alkali (NaOH) and oxygen at elevated temperature, increased pressure and at a relatively high pulp consistency.

When the pulp treated with oxygen in the presence of NaOH is washed, dissolved lignin and hemicellulose will be present in the washing solution together with the used alkali (NaOH). In the sulphate cooking process said washing solution can be utilized in such way that the used alkali hydroxide (NaOH) can be recovered and at the same time the heat value of the dissolved organic material which mainly comprises lignin and hemicellulose can be recovered by washing the unbleached pulp before the oxygen delignification by means of said washing solution.

Thus the sulphate cooking process will be supplied with a certain amount of sodium as a replacement for the sodium lost in the cooking process.

In the Na-sulphite cooking process some of the sodium loss can be replaced by means of the washings from the oxygen bleaching step when NaOH is used as the alkali during the bleaching.

If the sulphite cooking process is conducted with a different base than sodium the oxygen delignification with sodium hydroxide as the alkali will be of little interest from a recovery point of view. The washing water from the oxygen bleaching process containing NaOH can in this case not be utilized for washing in such way that it can be returned to the chemical recovery system, as this will result in an undesired admixture of sodium with the base used in the sulphite cooking process, e.g. Ca, Mg or $NH_3$.

In the case in which the sulphite mill has a chemical recovery plant and the digestion is effected with magnesium as the base, only an oxygen delignification in the presence of the corresponding base, i.e. $Mg(OH)_2$, will give the desired improvement with respect to both the effluent and chemical recovery situation in a similar way, e.g. as in a sulphate mill, in which delignification and bleaching is effected with $O_2$ in the presence of sodium hydroxide.

From page 152 of SSVL: "Teknisk sammenfatning" ("Technical Conclusion") from "Skogsindustrins miljovardsprojekt", printed in the beginning of 1974 it is stated: "Most sodium sulphite pulps intended for bleaching are cooked to a low lignin content, and oxygen bleaching will therefore offer little benefit from the pollution aspect. Since the magnesium base is likely to be the one mainly used in the future for the production of sulphite paper pulps having a higher lignin content, magnesium hydroxide should be used in preference to sodium hydroxide in the oxygen bleaching process. Studies in this direction have, however, yielded depressing results. With magnesium hydroxide alone as the alkali only 10–20 percent delignification has been obtained, and that is uninteresting from the environmental aspect. With mixtures of sodium and magnesium hydroxides the effect of delignification were negligibly higher than would be accounted for by the added sodium hydroxide."

In the same publication it is further stated: "For the future production of sulphite paper pulps the magnesium base will probably be used to an increasing extent. In the manufacture of magnefite pulps magnesium hydroxide is among the substances recovered. This has been examined as a source of alkali in laboratory-scale oxygen bleaching of a normal magnefite pulp (Kappa number ~30). The 10–20 percent delignification obtained is of little interest from the aspect of pollution. To achieve a level of delignification similar to that yielded by oxygen bleaching of pine kraft pulp — that is, a little over 50 percent — more than 20 kg of sodium hydroxide per ton of pulp is needed. The viscosity is then also comparable with that of the pine kraft pulp (Table 5.45, FIG. 5.66). Oxygen bleaching of magnefite pulps thus requires sodium hydroxide as the alkali source; in the recovery of the bleaching spent liquor sodium salts will therefore pass to the chemical recovery system."

From table 5.45 "Properties of oxygen-bleached magnefite pulp" oxygen bleaching is shown in the presence of only $Mg(OH)_2$ from which it is shown that the Kappa number is only reduced from 27.4 to 22.6, i.e. from a technical point an unimportant reduction of the Kappa number.

Thus the prior art should indicate that the use of magnesium as a base in oxygen delignification is not technically feasible. However, it has surprisingly been found that oxygen bleaching and delignification can be effected by the process in accordance with the invention.

By the process in accordance with the invention unbleached sulphite cellulose is admixed with a slurry of $Mg(OH)_2$ or a slurry of MgO, whereafter this pulp is dewatered by pressing or filtering in a known manner to a pulp consistency of 3-50 percent and then contacted with oxygen gas at a pressure higher than 4 kg/cm$^2$ above the atmospheric pressure and at a temperature in the range 90°–160° C, preferably at 120°–140° C for 0.5–6 hours to effect bleaching and delignification. The magnesium hydroxide can also be formed in situ by the addition of magnesium peroxide.

Thus with oxygen in the presence of 0.5–6 percent magnesium hydroxide lignin can be removed from the unbleached pulp, preferably a magnefite pulp which has been digested in a known manner with magnesium as the base and the effluent's content of organic materials and metal ions can be utilized in the mill's recovery process.

By known delignification with chlorine-containing chemicals, e.g. $Cl_2$, HOCl, this effluent cannot be returned for recovery due to difficulties caused by the chlorine content.

A further full bleaching of the pulp, preferably a sulphite pulp delignified and bleached with oxygen and $Mg(OH)_2$ can be effected in a known manner by means of chlorination, alkali extraction and hypochlorite or $ClO_2$.

In the subsequent table some results achieved by delignification of sulphite pulp by means of oxygen and magnesium hydroxide in accordance with the process of the invention are given.

| | | | | | | | | | | | | | |
|---|---|---|---|---|---|---|---|---|---|---|---|---|---|
| Pulp consistency, per cent | 32 | 32 | 32 | 23 | 22 | 26 | 25 | 25 | 25 | 20 | 38 | 32 | 34 |

-continued

| | | | | | | | | | | | | | |
|---|---|---|---|---|---|---|---|---|---|---|---|---|---|
| Mg $(OH)_2$ per cent by weight | 2 | 2 | 2 | 4 | 4 | 2 | 4 | 2 | 2 | 4 | 4 | 2 | 6 |
| $O_2$-pressure at room temperature, kg/cm$^2$ | 8 | 8 | 8 | 4 | 8 | 8 | 8 | 8 | 8 | 8 | 8 | 8 | 8 |
| Maximum temperature, ° C. | 135 | 135 | 135 | 140 | 140 | 130 | 130 | 130 | 140 | 130 | 130 | 130 | 130 |
| Time at max. temp., min. | 60 | 120 | 180 | 150 | 150 | 240 | 240 | 165 | 105 | 180 | 300 | 300 | 300 |
| Kappa number of the unbleached pulp | 17 | 17 | 17 | 55 | 55 | 22 | 22 | 24 | 24 | 39 | 39 | 39 | 39 |
| Per cent reduction of the Kappa number | 50 | 69 | 79 | 77 | 84 | 79 | 78 | 78 | 81 | 72 | 87 | 85 | 88 |
| Viscosity, SCAN cm$^3$/g | 1075 | 855 | 770 | 550 | 520 | 615 | 635 | 750 | 685 | 805 | 650 | 630 | 700 |
| Brightness, per cent SCAN | 51 | 55,5 | 61,5 | 45 | 49 | 62,5 | 63 | 52 | 52 | 51,5 | 62 | 59 | 63,5 |

The per cents by weight given are based on the dry pulp.
The viscosities of the unbleached pulps were SCAN 1100–1265 cm$^3$/g and SCAN brightness in the range 58–61 per cent.

I claim:

1. A process for delignification and bleaching of cellulose pulp comprising the steps of admixing unbleached sulphite cellulose pulp with a base consisting of a finely divided, solid magnesium compound selected from the group consisting of magnesium oxide, magnesium hydroxide and magnesium peroxide, and contacting the admixture at a pulp consistency of 3–50% with oxygen gas at elevated pressure at a temperature in the range of 90°–160° C for 0.5–6 hours in the absence of alkali metal hydroxide.

2. The process of claim 1 in which the oxygen treatment is carried out at a temperature in the range of 120°–140° C at a pressure of 4 kg/cm$^2$ above atmospheric pressure.

3. The process of claim 2 in which the magnesium compound is magnesium hydroxide used in the amount of 2–6% by weight.

* * * * *